US008678258B1

(12) United States Patent
Knight et al.

(10) Patent No.: US 8,678,258 B1
(45) **Date of Patent: *Mar. 25, 2014**

(54) BACKPACK BACK SUPPORT FRAME

(75) Inventors: Jeffrey S. Knight, Two Harbors, MN (US); Daniel R. Cruikshank, Two Harbors, MN (US)

(73) Assignee: GTG IP, LLC, Montgomery, AL (US)

( * ) Notice: Subject to any disclaimer, the term of this patent is extended or adjusted under 35 U.S.C. 154(b) by 562 days.

This patent is subject to a terminal disclaimer.

(21) Appl. No.: 12/975,047

(22) Filed: Dec. 21, 2010

Related U.S. Application Data

(60) Provisional application No. 61/291,689, filed on Dec. 31, 2009, provisional application No. 61/335,334, filed on Jan. 5, 2010.

(51) Int. Cl.
*A45F 3/08* (2006.01)

(52) U.S. Cl.
USPC ..... 224/628; 224/630

(58) Field of Classification Search
USPC ..... 224/628, 630; D3/216
See application file for complete search history.

(56) References Cited

U.S. PATENT DOCUMENTS

| | | | | |
|---|---|---|---|---|
| 5,131,576 | A | 7/1992 | Turnipseed | |
| 5,320,262 | A | 6/1994 | Levis | |
| 5,547,461 | A | 8/1996 | Levis | |
| 5,954,253 | A * | 9/1999 | Swetish | 224/631 |
| D468,792 | S * | 1/2003 | Jacoway et al. | D21/804 |
| 6,820,783 | B2 | 11/2004 | Beale | |
| 6,892,915 | B2 * | 5/2005 | Mares | 224/630 |
| D507,697 | S | 7/2005 | Seong | |
| 7,028,873 | B1 | 4/2006 | Collier et al. | |
| 7,337,935 | B1 * | 3/2008 | Glanville | 224/628 |
| 7,631,792 | B2 | 12/2009 | Christy | |
| 7,644,847 | B2 * | 1/2010 | Howell | 224/635 |
| 7,726,530 | B1 * | 6/2010 | Exposito | 224/630 |
| 7,793,809 | B2 * | 9/2010 | Howell | 224/628 |
| D630,011 | S * | 1/2011 | Knight et al. | D3/216 |
| 8,006,877 | B2 * | 8/2011 | Lowry et al. | 224/633 |
| 8,181,834 | B1 * | 5/2012 | Howell | 224/630 |
| 8,182,439 | B2 * | 5/2012 | Glenn | 602/19 |
| 8,398,337 | B2 * | 3/2013 | Jablonski | 405/187 |
| 2007/0090143 | A1 * | 4/2007 | Clayton et al. | 224/637 |

* cited by examiner

*Primary Examiner* — Justin Larson
(74) *Attorney, Agent, or Firm* — Bush Intellectual Property Law; Kenneth M. Bush

(57) ABSTRACT

A vertically and horizontally flexible backpack support frame having a Y-shaped configuration and fitting reversibly into a pocket on a backpack. The support frame is curved horizontally and vertically to conform to the shape of a back of a user. The frame has a raised Y-shaped corrugation for increased strength. A shoulder strap bar attaches reversibly across a longitudinal central opening in the support frame so that the shoulder strap bar is adjustable vertically and horizontally when the support frame is in the backpack. The backpack straps and belt attach reversibly and pivotably to the support frame when the support frame is in the pocket of the backpack.

17 Claims, 4 Drawing Sheets

BACKPACK BACK SUPPORT FRAME

CROSS-REFERENCE TO RELATED APPLICATIONS

The present application claims priority to U.S. Provisional Patent Application No. 61/291,689, filed Dec. 31, 2009, and U.S. Provisional Patent Application No. 61/335,334, filed Jan. 5, 2010, the disclosures of which are incorporated herein by reference.

FIELD OF THE INVENTION

The present invention relates to back support frames for a backpack and, more particularly, to an internal backpack back support frame shaped to the contour of the spine and back of a user, engineered to match and support the ergonomic flexural characteristics of the human back in both vertical and horizontal directions, having shoulder straps and a belt attached reversibly thereto, and having an adjustable shoulder strap bar accessible from a sleeve into which the support frame is reversibly inserted and retained.

BACKGROUND OF THE INVENTION

Internal frame packs are generally characterized by having several various sized pocket compartments into which a metal support frame is placed. Typically, tubular sleeves are sewn onto the inside of the largest, lower compartment of the pack into which metal strips or stays are slidably placed. The stays are commonly made of high grade aluminum which is bent to the vertical contours of the wearers back. Usually the stays are attached onto a sheet of HDPE Plastic which provides a rigid surface. On the outside of this rigid surface the shoulder straps and waist belt are attached, so that the weight of the load in the pack is transferred to the waist belt of the user, and not the shoulders. An important benefit of an internal frame pack is that it fits closely to the body of the user. This close fit provides a low center of gravity, and the separate strips or stays of the internal frame allow the pack to move with the user (torsional flex). A common problem with internal frame packs is a lack of good support by the internal frame. Since the aluminum stays are designed to be bent to the contours of the wearers back, they can easily become deformed under heavy loads or if the pack is dropped. The greater the load, the more deformed the support stays become. Thus, with larger loads, weight transfer to the waist belt is often inefficient or ineffective. Other related problems with internal frame packs are the discomfort and fatigue suffered by the wearer because the frame is flimsy and insubstantial. As more is loaded into the pack, it bows away from the user's back failing to transfer the load to the waist, and instead putting more of the load on the user's shoulders. Another problem relates to the shape of the traditional internal support frame, being only contoured to the vertical contours of back, resulting in the frame being able to shift horizontally when the back is subjected to side to side movements. Finally the flexibility of the common internal support frame is consistent form top to bottom, unlike the human back which flexes differently in the lumbar region, the thoracic region and the shoulder region, causing a discomfort from either being too stiff in the lumbar region or too soft in the thoracic or shoulder strap region.

U.S. Pat. No. 5,320,262 discloses an internal frame backpack having a single frame member made of a plurality of rigid strips wherein the frame fits into a single zippered pocket on the backpack. Shoulder straps and a belt are sewn to the pocket and are not directly attached the frame. Consequently, the frame can move within the pocket relative to the user so that the conformation of the frame to the back of the user is not always optimal. In addition, the need for this type of frame to be rigid in a vertical direction makes the frame relatively uncomfortable since it will not flex with the forward and backward rotations of the user's back.

SUMMARY OF THE INVENTION

The present invention is a backpack support frame having a top-end and a bottom end, wherein the top end is greater in horizontal length than the bottom end so that the support frame has a Y-shaped configuration. The support frame is curved horizontally and vertically to conform to the shape of a back of a user, and extends in length at least from the cervical to the sacral portions of a spinal column. The frame has a front face and an opposite rear face, with the rear face having a raised Y-shaped structure for reinforcement. An upper portion of the support frame has a longitudinal central opening, and a plurality of holes positioned on either side of the longitudinal central opening. The raised Y-shaped structure has a lower stem which originates in a lower portion of the frame, extends towards the longitudinal central opening, and branches left and right to form branches which extend around the longitudinal central opening. A middle portion is in between the upper portion and the lower portion, wherein the lower portion has a degree of flexibility up to 30 degrees, the middle portion has a degree of flexibility up to 12 degrees, and the upper portion has a degree of flexibility up to 5 degrees. The front face has a recessed Y-shaped structure or no Y-shaped structure at all. A shoulder strap bar is reversibly attached to the rear face across the longitudinal central opening. The attachment is by means of insertion of threaded studs on the shoulder strap bar through the holes positioned on either side of the longitudinal opening. A belt bracket having a threaded stud is attached to the front face at the bottom end of the support frame.

The backpack support frame of the present invention has many advantages. The frame comprises a three-dimensionally molded composite backpack support frame that fits both the vertical and horizontal contours of the wearer's back. The support frame is shaped so as to accommodate the curves of the spinal column including the pelvic region, lumbar region, the thoracic region, as well as the cervical region. In addition, contours of the support frame are shaped to conform to the major muscle groups of the back, including the latissimus dorsi and the trapezius. A functional advantage of the support frame's shape is to allow the backpack to fit more of the contours of the back, and thus distribute the load across a larger cross-sectional area of the wearer's back. By conforming to the contours of the major muscle groups, the support frame promotes better blood flow and thus better oxygenation of those muscles, resulting in less muscle fatigue and greater comfort.

The support frame is designed to fit reversibly into a sleeve or pocket on the back of a backpack, or attach reversibly to the backpack with connecting straps or a combination of the two methods. Foam padding can be added between the support frame and the wearer's back. The shoulder straps are allowed to pivot on studs attached to the support frame, allowing the shoulder straps to adjust to the cant of the top of the wearer's shoulder.

The hip belt wraps around the rear side of the support frame and thus pulls the support frame into the pelvic and lumbar zones as the belt is tightened. The hip belt incorporates a grommet and the support frame provides a stud to secure the belt in place, and to allow for the transfer of weight from the support frame to the belt. The belt can pivot on the stud, allowing for the wearer's freedom of movement in the hip and pelvic region.

The support frame is engineered to flex with the wearer's back while still supporting significant loads, similar to the human spinal column. There are three distinct zones of flexibility engineered by using the material itself in combination with a raised Y-shaped ridge. In the pelvic and lumbar region, the frame sheet flexes relatively easily, absorbing the kinetic energy of the backpack as it moves up and down with the wearer's gait, and easily flexing to nest into the exact shape of the wearer's lumbar curve, which can be different between individual users.

In the lower thoracic region, the support frame flex is relatively moderate, allowing for flex as the wearer bends forward and back, as well as torsional movement. In the upper thoracic and cervical regions, the frame sheet becomes relatively stiff, allowing the wearer to pull the support frame and backpack into the upper thoracic region by means of load lifter straps which can attach at the top of the support frame pocket on one end and at the peak of the shoulder strap on the other end. This allows for improved load stability.

The shoulder strap bracket or bar can be adjusted to attach the shoulder straps in multiple width positions. This allows for variations in the wearer's chest width, as well as the differences associated in chest width when wearing bulky apparel or body armor. The shoulder bracket or bar can adjust to various widths by means of a sliding mechanism.

DETAILED DESCRIPTION OF THE INVENTION

Figure 1:
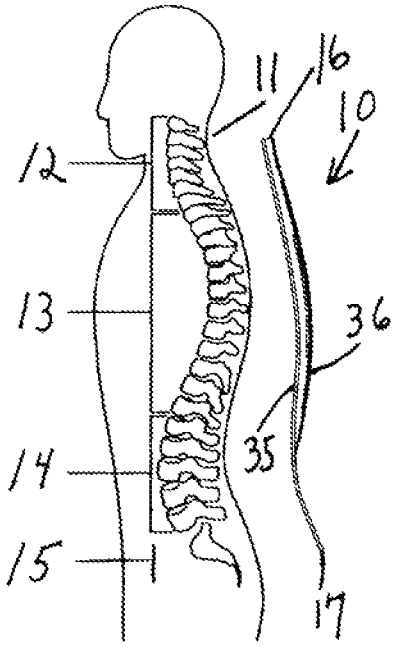
FIG. 1 shows a side view of the backpack back support frame of the present invention in relation to a spinal column.

The present invention is a back support frame for a backpack. It fits within a pocket or sleeve on the back of a backpack, and shoulder straps and a belt attach directly to the support frame. FIG. 1 shows a side view of the support frame 10 which is curved horizontally and vertically to conform to the shape of the spinal column 11 and the back of a user. Support frame 10 has a top end 16 and a bottom end 17, and it extends in length from the top of the spinal column 11 (cervical portion 12) to the bottom of the spinal column 11 (sacral 15 portion). Thus, the support frame 11 provides support to the thoracic 13, lumbar 14, and sacral 15 portions of the spinal column 11.

Figure 2:
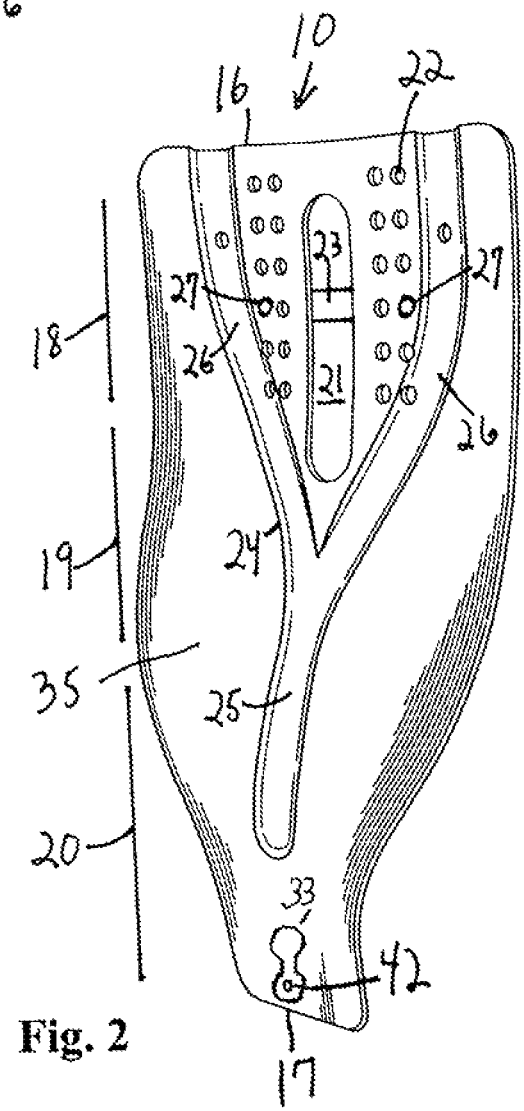
FIG. 2 shows a front perspective view of the support frame.
Figure 7:
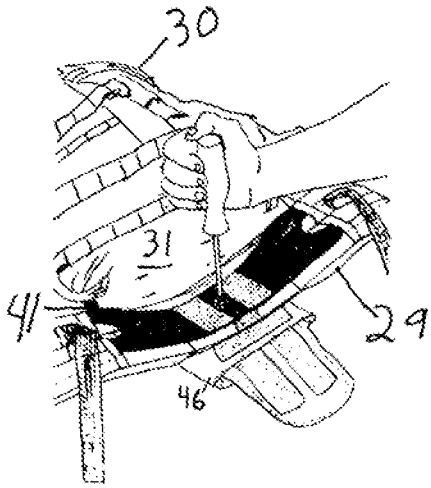
FIG. 7 illustrates how the belt is attached to the belt bracket by means of inserting a screw into an internally threaded stud on the belt bracket.
Figure 8:
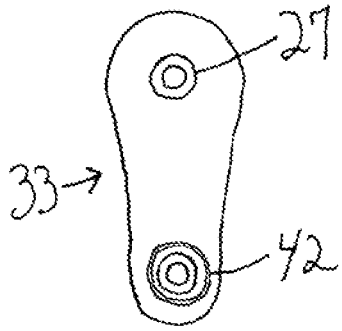
FIG. 8 shows the belt bracket having an internally threaded stud on one end for attaching a belt to the support frame and a rivet on an opposite end for attaching the belt bracket to the support frame.

FIG. 2 shows a front perspective view of the support frame 10 wherein the top end 16 is greater in horizontal length than the bottom end 17 so that support frame 10 has a Y-shaped configuration. Support frame 10 has an upper region 18, a middle region 19, and a lower region 20. Lower region 20 has the greatest degree of flexibility, up to 30 degrees. The middle region 19 has a moderate degree of flexibility, up to 12 degrees. The upper region 18 is relatively rigid with flexibility of only up to 5 degrees. The upper region 18 has a longitudinal central opening 21. A plurality of holes 22 are positioned equally on either side of the longitudinal opening 21. Support frame 10 has a front face 35 and an opposite rear face 36 (see FIG. 3). Support frame 10 also has a recessed Y-shaped structure 24 in the front face 35. The recessed Y-shape 24 has a lower stem 25 which originates in lower region 20 and extends upward towards the longitudinal central opening 21. It then branches left and right to form branches 26 which extend around the longitudinal opening 21. Bottom end 17 has a belt bracket 33 for attaching a belt 29 to support frame 10 (see (FIGS. 4, 7, and 8). Belt bracket 33 is fastened at the bottom end 17 with a rivet 42.

A shoulder strap bar 23 having internally threaded studs 27 can be positioned on the rear face 36 horizontally across the longitudinal opening 21. The threaded studs 27 can be inserted through the holes 22 to engage screws for pivotal attachment of shoulder straps 28 (see FIGS. 4, 6 and 9) to the support frame 10. The shoulder strap bar 23 can be grasped by a user from the front face 35 through longitudinal opening 21 so that it can be raised, lowered, and inserted in any desired holes 22 to reversibly attach the shoulder straps 28 on the front face 35 as desired.

Figure 3:
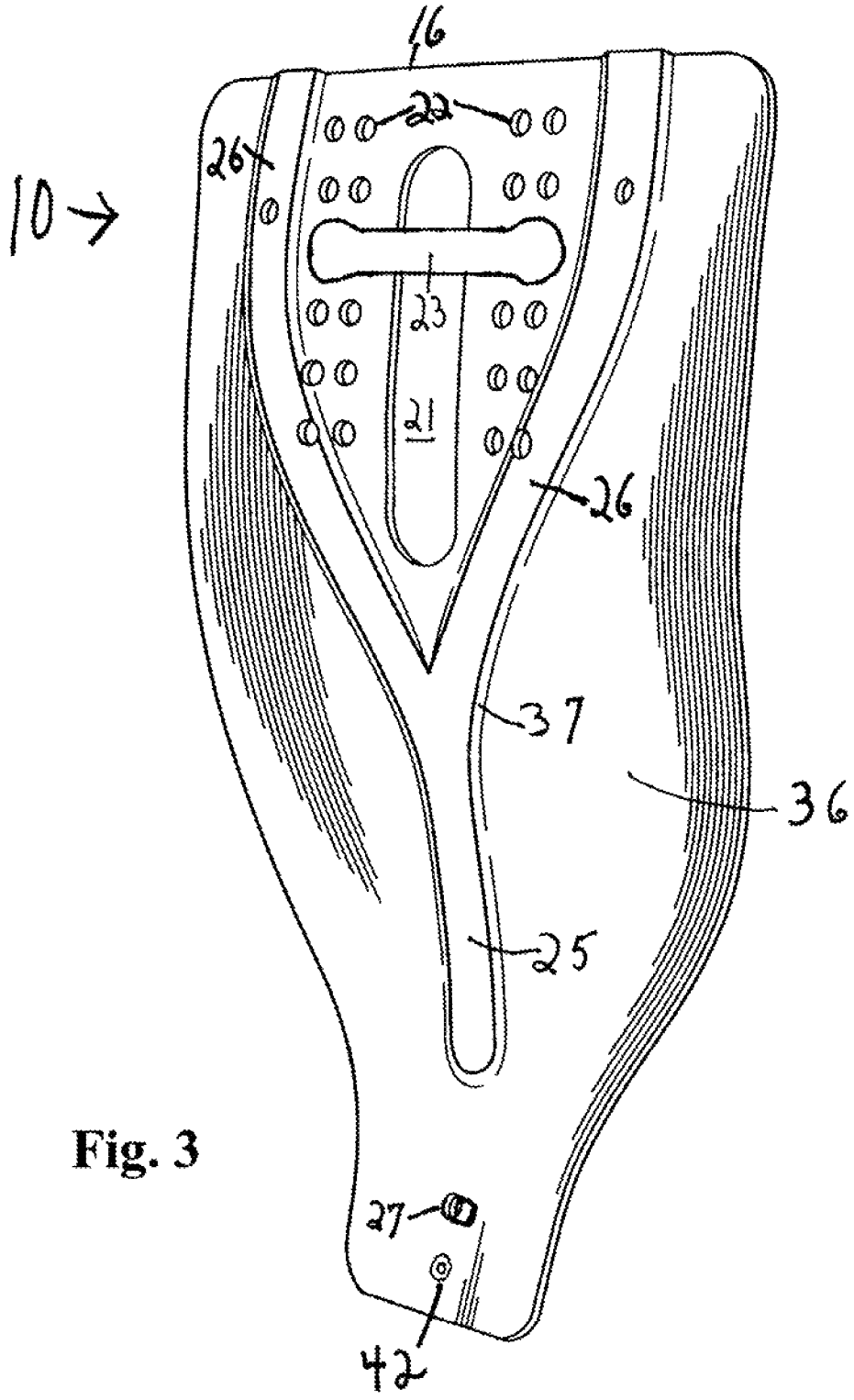
FIG. 3 shows a rear perspective view of the support frame.
Figure 4:
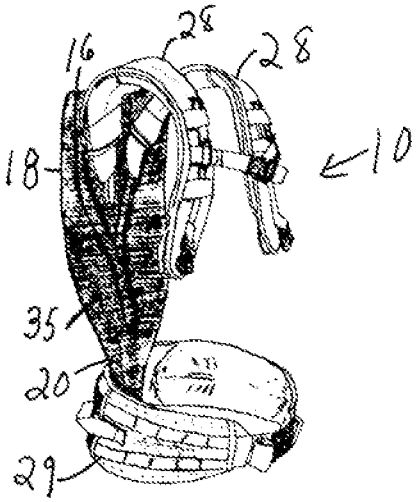
FIG. 4 shows the support frame having shoulder straps attached to the front face in the upper region, and belt attached to the rear face in the lower region.

FIG. 3 shows a rear perspective view of the support frame 10. The shoulder strap bar 23 is shown in position on the rear face 36 extending horizontally across the longitudinal opening 21. The bottom end 17 has holes for the insertion of a threaded stud 27 and a rivet 42 from belt bracket 33. The rivet 42 attaches the belt bracket 33 to support frame 10, and the threaded stud 27 provides for pivotal attachment of belt 29 to the belt bracket 33. (see FIGS. 4, 7, and 8). Rear face 36 has a raised Y-shaped structure 37 corresponding to the recessed Y-shaped structure 24 on the front face 35. In an alternative arrangement the front face 35 may have no recessed Y-shaped structure 24. The Y-shaped structures or corrugations 24, 37 help produce the desired strength, shape, and flexibility to support frame 10. The degree of flexibility in the support frame 10 is also adjusted by its thickness and composition. Support frame 10 can be made of any suitable material, preferably plastic, continuously reinforced composite or long strand fiber reinforced.

Figure 5:
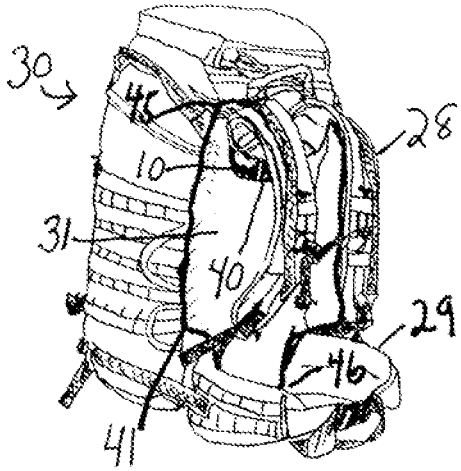
FIG. 5 shows the support frame reversibly inserted into a pocket of backpack.

FIG. 4 shows the support frame 10 having shoulder straps 28, attached reversibly and pivotably to the front face 35 in the upper region 18, and belt 29, attached reversibly and pivotably to the rear face 36 in the lower region 20. FIG. 5 shows the support frame 10 reversibly inserted into a pocket 31 of backpack 30. Pocket 31 is closed at its top end 45 and is open near the bottom end 46 at position 41. The pocket 31 tapers from position 41 to bottom end 46, conforming to the shape of support frame 10. Pocket 31 has an opening 40 near the top end 45 where the shoulder straps 28 extend out from the pocket 31.

Figure 6:
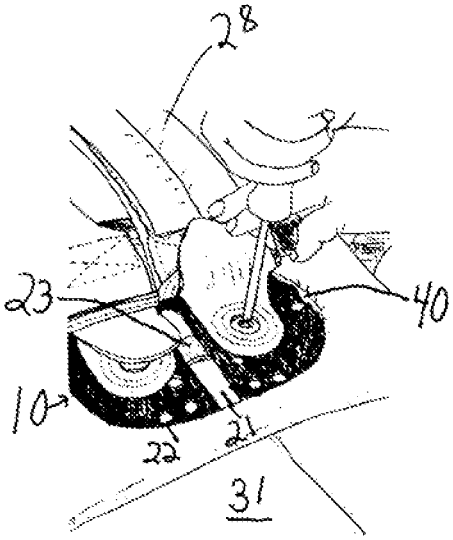
FIG. 6 illustrates how the shoulder straps are attached to the strap bar by means of inserting screws into internally threaded studs.

FIG. 6 illustrates how the straps 28 are attached to the strap bar 23 by means of inserting screws into the internally threaded studs 27. This can be performed without removing the support frame 10 from pocket 31. The opening 40 in pocket 31 provides access to support frame 10, longitudinal opening 21, and strap bar 23. As noted above, the shoulder strap bar 23 can be grasped by a user from the front face 35 through longitudinal opening 21 so that it can be raised, lowered, and inserted in any desired holes 22 to place the shoulder straps 28 on the front face 35 as desired. FIG. 7 illustrates how the belt 29 is attached to the belt bracket 33 by means of inserting a screw into an internally threaded stud 27. This can be performed without removing the support frame 10 from pocket 31 since the bottom insertion position 41 of pocket 31 is open.

Figure 9:
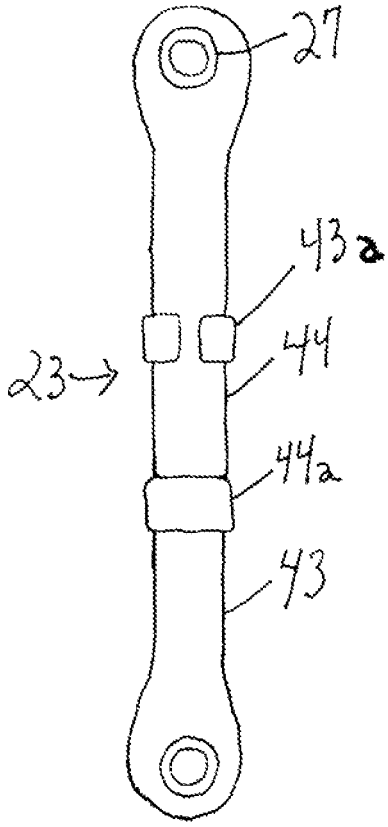
FIG. 9 shows the shoulder strap bar having an internally threaded stud on each end for attaching a shoulder strap bar to the support frame horizontally across the longitudinal opening.

FIG. 8 shows the belt brace 33 having an internally threaded stud 27 on one end for attaching belt 29 to frame 10 and a rivet 42 on an opposite end for attaching the belt bracket 33 to support frame 10. FIG. 9 shows the shoulder strap bar 23 having an internally threaded stud 27 on each end for attaching shoulder strap bar 23 to frame 10 horizontally across the longitudinal opening 21. Shoulder strap bar 23 is adjustable horizontally for spacing the shoulder straps 28 closer together or further apart. The strap bar 23 has two overlapping arms 43, 44 which have clamps 43*a* and 44*a* at their tips which hold the arms 43, 44 together but allow them to slide across each other to shorten or lengthen the strap bar 23. Both the shoulder straps 28 and the belt 29 pivot on their points of attachment to support frame 10.

Figure 10:
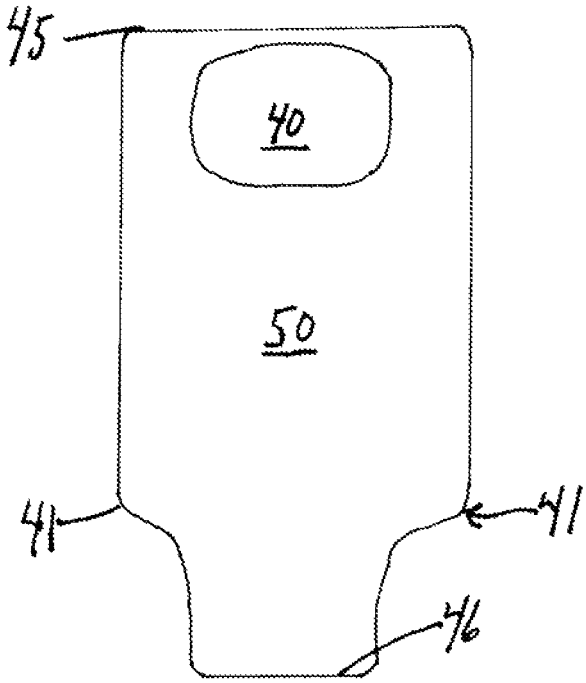
FIG. 10 shows a pocket flap which can be sewn to any suitable backpack to form a pocket for insertion of the support frame of the present invention.

FIG. 10 shows a pocket flap or sleeve 50 which can be sewn to any suitable backpack to form a pocket 31 for insertion of support frame 10. The pocket flap 50 can be sewn along its top end 45 and to the open position 41. The pocket flap 50 can also be attached by other means well known in the art. The pocket flap may hold foam padding.

A kit can be created to provide a support frame for a backpack comprising a support frame 10 of the present invention, a strap bar 13, a belt bracket 33, shoulder straps 28 constructed for attachment to strap bar 23, a belt 29 constructed for attachment to belt bracket 33, and a pocket flap 50 to form a pocket 31 on a backpack. The kit may also include straps to attach the support frame 10 to a backpack rather than using a pocket.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, it is understood from the above description and figures that shoulder straps 28 can be positioned closer to top end 16 or away from top end 16 of support frame 10, by means of shoulder strap bar 23, to accommodate the vertical length of the torso of a user. Likewise, the shoulder straps 23 can be positioned closer to the longitudinal opening 21 or further away from longitudinal opening 21, by means of shoulder strap bar 23, to accommodate the horizontal width of the back of a user.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A backpack support frame, comprising:

a) a support frame having a top-end and a bottom end wherein the top end is greater in horizontal length than the bottom end so that said support frame has a Y-shaped configuration;

b) said support frame being curved horizontally and vertically to conform to the shape of a back of a user, and extending in length at least from the thoracic to the sacral portions of a spinal column;

c) said support frame having a front face and an opposite rear face, said rear face having a raised Y-shaped structure;

d) said support frame having an upper portion with a longitudinal central opening, and a plurality of holes positioned on either side of the longitudinal central opening; and e) said support frame having a lower portion, said raised Y-shaped structure having a lower stem which originates in said lower portion, extending towards the longitudinal central opening, and branching left and right to form branches which extend around said longitudinal central opening.

2. The backpack support frame according to claim 1, further comprising a recessed Y-shaped structure on the front face.

3. The backpack support frame according to claim 1, further comprising a middle portion in between the upper portion and the lower portion, wherein the lower portion has a degree of flexibility up to 30 degrees, the middle portion has a degree of flexibility up to 12 degrees, and the upper portion has a degree of flexibility up to 5 degrees.

4. The backpack support frame according to claim 1, further comprising a shoulder strap bar reversibly attached across said longitudinal central opening on the rear face of the upper portion of the support frame, by insertion of threaded studs on said shoulder strap bar through the holes positioned on either side of the longitudinal opening.

5. The backpack support frame according to claim 1, further comprising a belt bracket having a threaded stud, wherein said belt bracket is attached to the front face at the bottom end of the support frame.

6. The backpack support frame according to claim 1, wherein the support frame is reversibly insertable into a pocket on a backpack.

7. The backpack support frame according to claim 4, wherein said shoulder strap bar is vertically and horizontally adjustable on the support frame by means of attachment in the holes positioned on either side of the longitudinal opening.

8. A backpack support frame, comprising:

a) a support frame having top-end and a bottom end wherein the top end is greater in horizontal length than the bottom end so that said support frame has a Y-shaped configuration;

b) said support frame being curved horizontally and vertically to conform to the shape of a back of a user, and extending in length at least from the thoracic to the sacral portions of a spinal column;

c) said support frame having a front face and an opposite rear face, said rear face having a raised Y-shaped structure;

d) said support frame having an upper portion with a longitudinal central opening, and a plurality of holes positioned on either side of the longitudinal central opening;

e) said support frame having a lower portion, said raised Y-shaped structure having a lower stem which originates in said lower portion, extending towards the longitudinal central opening, and branching left and right to form branches which extend around said longitudinal central opening;

f) a recessed Y-shaped structure on the front face;

g) a shoulder strap bar reversibly attached across said longitudinal central opening on the rear face of the upper portion of the support frame, by insertion of threaded studs on said shoulder strap bar through the holes positioned on either side of the longitudinal opening; and h) a belt bracket having a threaded stud, wherein said belt bracket is attached to the front face at the bottom end of the support frame.

9. The backpack support frame according to claim 8, further comprising a middle portion in between the upper portion and the lower portion, wherein the lower portion has a degree of flexibility up to 30 degrees, the middle portion has a degree of flexibility up to 12 degrees, and the upper portion has a degree of flexibility up to 5 degrees.

10. The backpack support frame according to claim 8, wherein the support frame is reversibly insertable into a pocket on a backpack.

11. The backpack support frame according to claim 8, wherein said shoulder strap bar is vertically and horizontally adjustable on the support frame by means of attachment in the holes positioned on either side of the longitudinal opening.

12. A backpack support frame, comprising:

a) a support frame having top-end and a bottom end wherein the top end is greater in horizontal length than the bottom end so that said support frame has a Y-shaped configuration;

b) said support frame being curved horizontally and vertically to conform to the shape of a back of a user, and extending in length at least from the thoracic to the sacral portions of a spinal column;

c) said support frame having a front face and an opposite rear face, said rear face having a raised Y-shaped structure;

d) said support frame having an upper portion with a longitudinal central opening, and a plurality of holes positioned on either side of the longitudinal central opening;

e) said support frame having a lower portion, said raised Y-shaped structure having a lower stem which originates in said lower portion, extending towards the longitudinal central opening, and branching left and right to form branches which extend around said longitudinal central opening;

f) said support frame having a middle portion in between the upper portion and the lower portion, wherein the lower portion has a degree of flexibility up to 30 degrees, the middle portion has a degree of flexibility up to 12 degrees, and the upper portion has a degree of flexibility up to 5 degrees;

g) a recessed Y-shaped structure on the front face;

h) a shoulder strap bar reversibly attached across said longitudinal central opening to the rear face of the upper portion of the support frame, by insertion of threaded studs on said shoulder strap bar through the holes positioned on either side of the longitudinal opening, wherein said shoulder strap bar is vertically and horizontally adjustable on the support frame; and i) a belt bracket having a threaded stud, wherein said belt bracket is attached to the front face at the bottom end of the support frame.

13. A kit for providing a backpack support frame, said kit comprising:

1) a support frame having a top-end and a bottom end wherein the top end is greater in horizontal length than the bottom end so that said support frame has a Y-shaped configuration; said support frame being curved horizontally and vertically to conform to the shape of a back of a user, and extending in length at least from the thoracic to the sacral portions of a spinal column; said support frame having a front face and an opposite rear face, said rear face having a raised Y-shaped structure; said support frame having an upper portion with a longitudinal central opening, and a plurality of holes positioned on either side of the longitudinal central opening; and said support frame having a lower portion, said raised Y-shaped structure having a lower stem which originates in said lower portion, extending towards the longitudinal central opening, and branching left and right to form branches which extend around said longitudinal central opening;

2) a shoulder strap bar reversibly attachable across said longitudinal central opening on the rear face of the upper portion of the support frame, by insertion of threaded studs on said shoulder strap bar through the holes positioned on either side of the longitudinal opening; and 3) a belt bracket having a threaded stud, wherein said belt bracket is attachable to the front face at the bottom end of the support frame.

14. The kit according to claim 13 further comprising a middle portion in between the upper portion and the lower portion of the support frame, wherein the lower portion has a degree of flexibility up to 30 degrees, the middle portion has a degree of flexibility up to 12 degrees, and the upper portion has a degree of flexibility up to 5 degrees; wherein the support frame is reversibly insertable into a pocket on a backpack; and wherein said shoulder strap bar is vertically and horizontally adjustable on the support frame by means of attachment in the holes positioned on either side of the longitudinal opening.

15. The kit according to claim 14, further comprising shoulder straps constructed for reversible, pivotable attachment to the shoulder strap bar, and a belt constructed for reversible, pivotable attachment to the belt bracket.

16. The kit according to claim 15, further comprising a pocket flap to form a pocket on a backpack for reversible insertion of the support frame into the pocket.

17. The kit according to claim 16, further comprising straps for attachment of the support frame to a backpack.

* * * * *